US007171946B1

(12) United States Patent
Watanabe

(10) Patent No.: US 7,171,946 B1
(45) Date of Patent: Feb. 6, 2007

(54) ELECTRONIC THROTTLE CONTROL APPARATUS

(75) Inventor: Shinji Watanabe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/387,948

(22) Filed: Mar. 24, 2006

(30) Foreign Application Priority Data

Nov. 15, 2005 (JP) ..... 2005-330181

(51) Int. Cl.
*F02D 11/10* (2006.01)
*F02D 11/00* (2006.01)

(52) U.S. Cl. ..... 123/399

(58) Field of Classification Search ..... 123/199, 123/396, 361; 73/118.1, 118.2; 701/107
See application file for complete search history.

(56) References Cited

U.S. PATENT DOCUMENTS 6,154,351 A * 11/2000 Takano et al. ..... 361/23
6,199,535 B1 * 3/2001 Hara ..... 123/396

FOREIGN PATENT DOCUMENTS

JP 10-176548 6/1998

* cited by examiner

*Primary Examiner*—Mahmoud Gimie
(74) *Attorney, Agent, or Firm*—Sughrue Mion, PLLC

(57) ABSTRACT

An electronic throttle control apparatus can detect a motor open-circuit failure without detecting a motor current. A throttle opening sensor detects an actual throttle opening position (ATOP) of a throttle valve, and a throttle actuator serves to drive the throttle valve and hold the throttle valve at an intermediate opening stopper position (IOSP) during non-energization of the motor. The throttle actuator is feedback controlled such that the ATOP coincides with a target throttle opening position (TTOP). When the throttle valve continues, for a predetermined time, a state in which the absolute value of an opening position deviation between the ATOP and the IOSP is less than or equal to a first predetermined value, and in which the absolute value of a control deviation between the TTOP and the ATOP is larger than or equal to a second predetermined value, it is determined that the motor is in an open-circuit failure.

5 Claims, 8 Drawing Sheets

ELECTRONIC THROTTLE CONTROL APPARATUS

BACKGROUND OF THE INVENTION

1. Field of the Invention

The present invention relates to an electronic throttle control apparatus that serves to detect an open-circuit failure of a motor in a throttle actuator for controlling the amount or degree of opening of a throttle valve arranged in an intake pipe of an automotive engine.

2. Description of the Related Art

In a throttle control apparatus for detecting an open-circuit failure of a motor energization system in an throttle actuator, a motor for driving a throttle valve is controlled in a PWM (pulse width modulation) manner, and a motor current is controlled by changing a drive duty ratio in the PWM control, so that the degree of opening of the throttle valve is adjusted to a target opening degree. In such a throttle control apparatus, when the drive duty ratio is higher than a predetermined value, and when the current flowing through the motor is less than a predetermined value, it is determined that an open circuit occurs in the motor (see, for example, a first patent document: Japanese patent No. 3,189,717).

However, it is necessary to detect the current flowing through the motor so as to find an open-circuit of the motor, so there is a problem that a current detection circuit is required, thus adding to the cost of manufacture thereof.

In addition, in case where the throttle actuator is driven to operate by controlling the motor current through PWM driving, an electric time constant of the motor used in the throttle actuator is generally small, and hence the pulsation (ripple) of the motor current generated due to the on/off control of the energization of a motor winding at the time of PWM driving is large, so the detected value of the motor current will also vary greatly depending upon current detection timing in a PWM drive period, thus posing another problem that it becomes difficult to properly make the setting of a current value used for the determination of detection of a motor open circuit.

Moreover, in case where a shunt resistor for detection of the motor current is provided so that a motor current signal flowing through the shunt resistor is input as a voltage signal to an AD converter and is AD converted at predetermined timing synchronized with the above-mentioned PWM drive period so as to detect the motor current, there is a further problem that the processing load of the microcomputer is increased.

Further, in case where the motor current signal is to be smoothed for current detection by means of a smoothing circuit for the purpose of reducing the processing load of the microcomputer, there arises a still further problem of generation of a detection delay.

SUMMARY OF THE INVENTION

Accordingly, an object of the present invention is to provide an electronic throttle control apparatus which is capable of detecting an open-circuit failure of a motor without detecting a motor current.

Bearing the above object in mind, according to the present invention, there is provided an electronic throttle control apparatus including a throttle valve that adjusts an amount of intake air sucked into an engine, a throttle opening sensor that detects an actual throttle opening position of the throttle valve, and a throttle actuator that includes a motor for driving the throttle valve and an intermediate opening position stopping mechanism for holding the throttle valve at an intermediate opening stopper position when the motor is not energized, the throttle actuator being controlled in a throttle opening feedback manner such that the actual throttle opening position detected by the throttle opening sensor coincides with a target throttle opening position. During the throttle opening feedback control of the throttle actuator, when the throttle valve continues, for a predetermined period of time, a state in which the absolute value of an opening position deviation between the actual throttle opening position and the intermediate opening stopper position is less than or equal to a first predetermined value, and a state in which the absolute value of a control deviation between the target throttle opening position and the actual throttle opening position is larger than or equal to a second predetermined value, it is determined that the motor is in an open-circuit failure.

According to the electronic throttle control apparatus of the present invention as described above, there is obtained the following advantageous effect. That is, by focusing attention to the fact that when a motor open-circuit failure occurs, the throttle valve is mechanically returned to the intermediate opening stopper position by means of the intermediate opening position stopping mechanism, the absolute value of the opening position deviation between the actual throttle opening position and the intermediate opening stopper position is less than or equal to the first predetermined value during throttle opening feedback control through energization of the DC motor, so it is verified that the throttle valve has been returned to the intermediate opening stopper position, and at the same time, the absolute value of the control deviation between the target stopper opening position and the stopper opening position is larger than or equal to the second predetermined value, so it is also verified that the motor current is increased so as to reduce the control deviation to zero through the throttle opening feedback control. When these states continue over the predetermined period of time, it is determined that the motor energization system is in an open-circuit failure. As a result, it is possible to detect the open-circuit failure of the motor energization system in a reliable manner without the need of detecting a motor current.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Hereinunder, preferred embodiments of the present invention will be described in detail while referring to the accompanying drawings.

Embodiment 1

Figure 1:
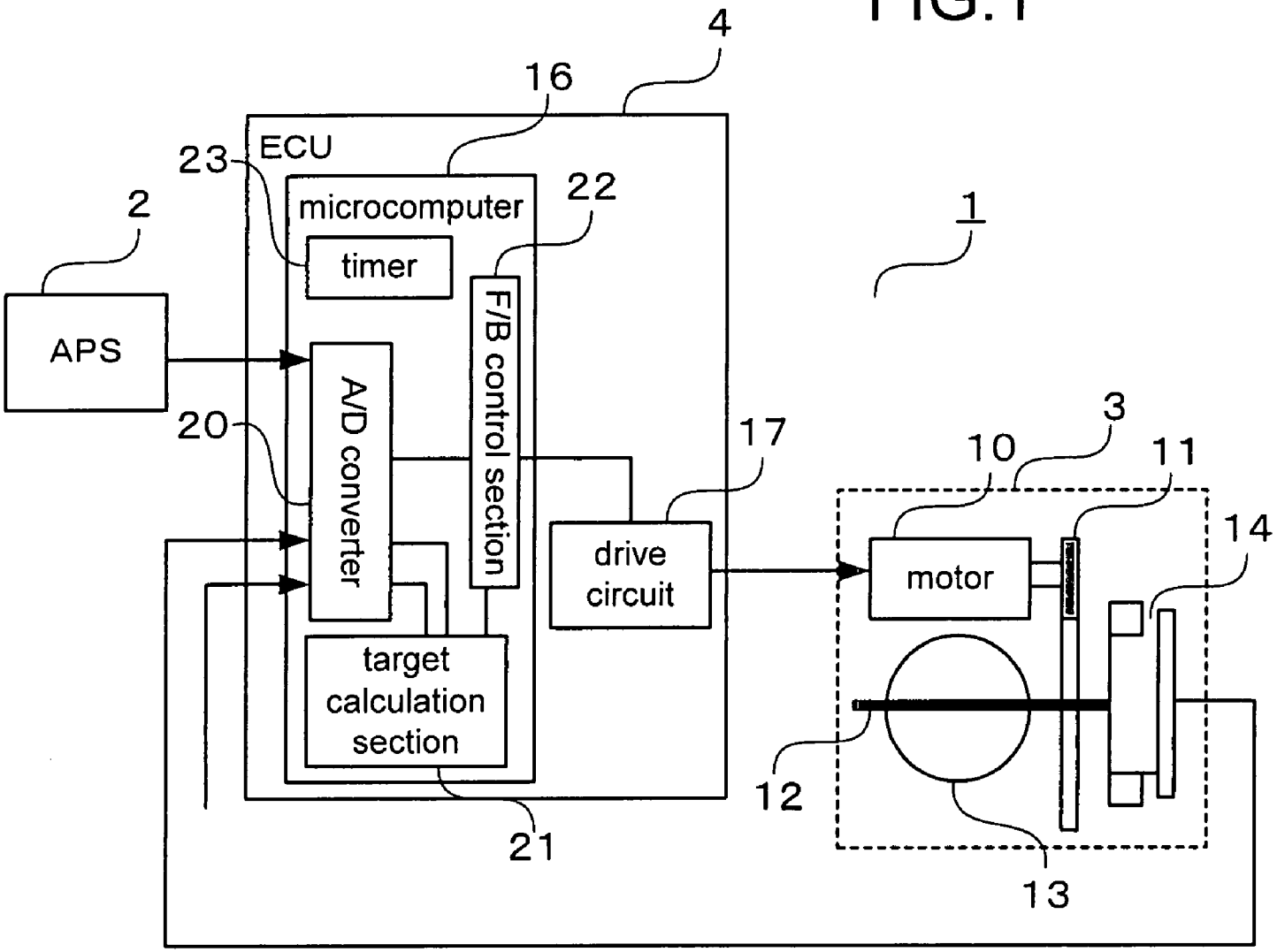
FIG. 1 is a block diagram showing the configuration of an electronic throttle control apparatus according to a first embodiment of the present invention.
Figure 2:
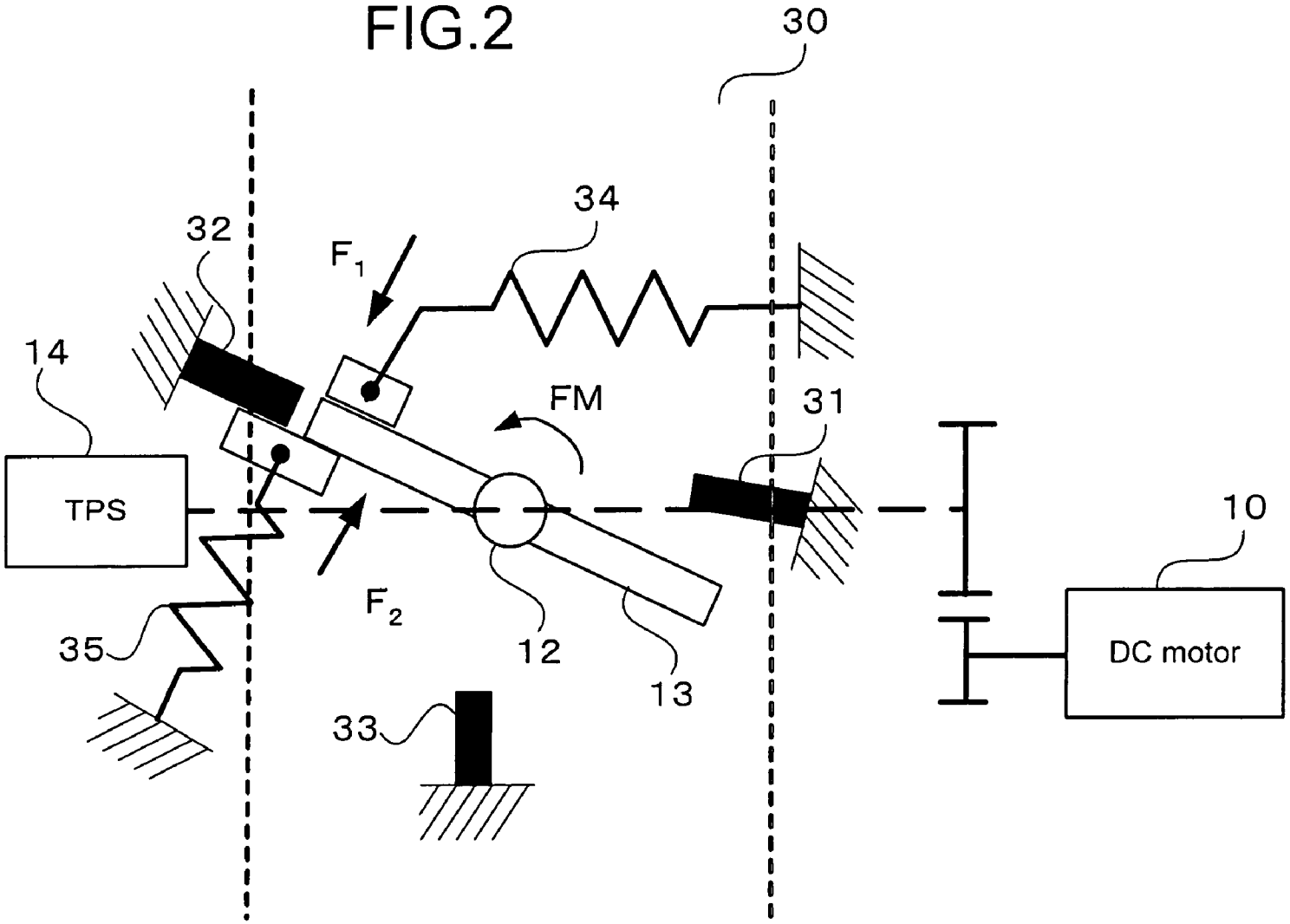
FIG. 2 is a construction view around a throttle valve that is stopped in an intermediate opening stopper position.
Figure 3:
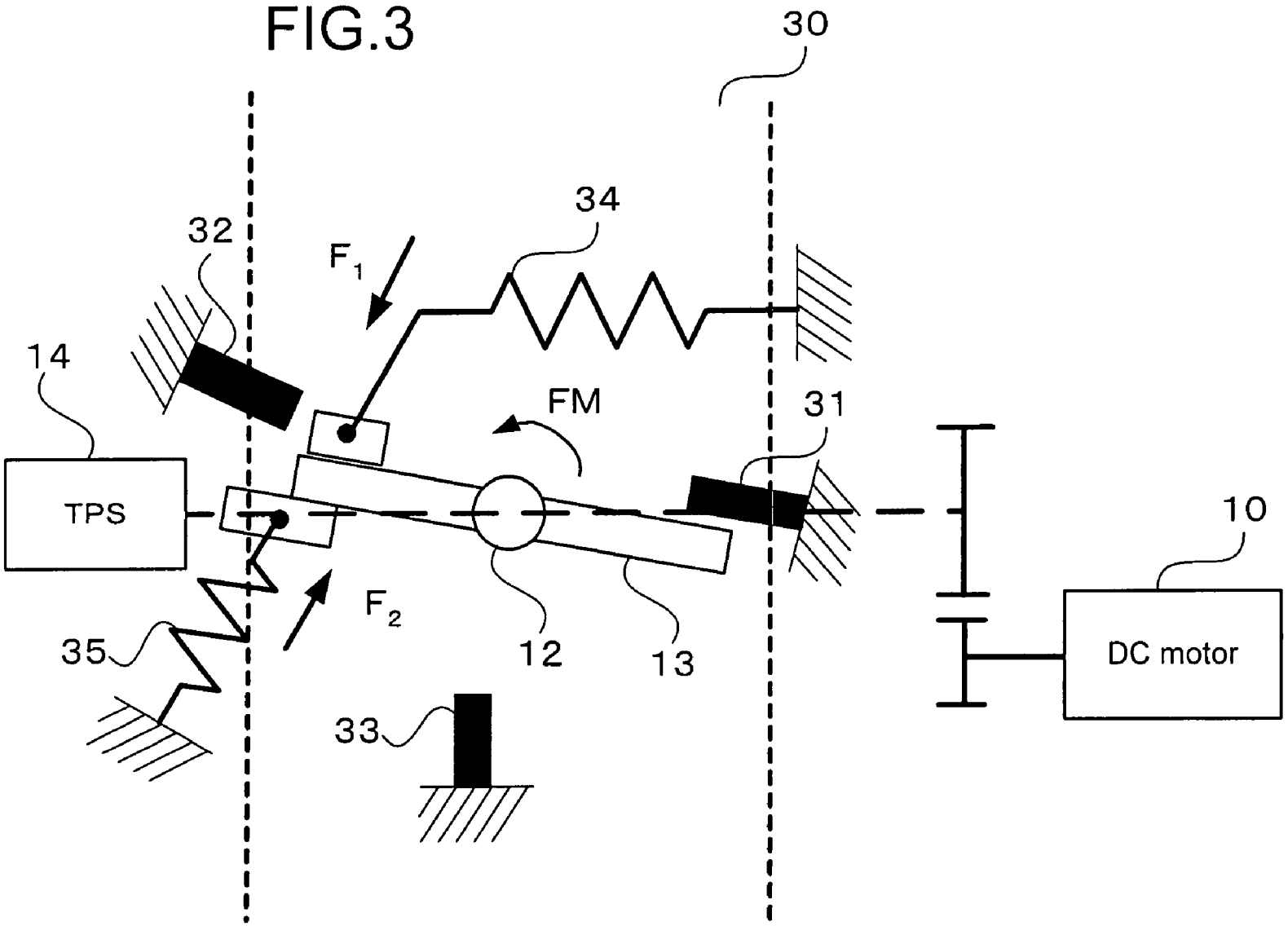
FIG. 3 is a construction view around the throttle valve that is stopped in the vicinity of its fully closed position.
Figure 4:
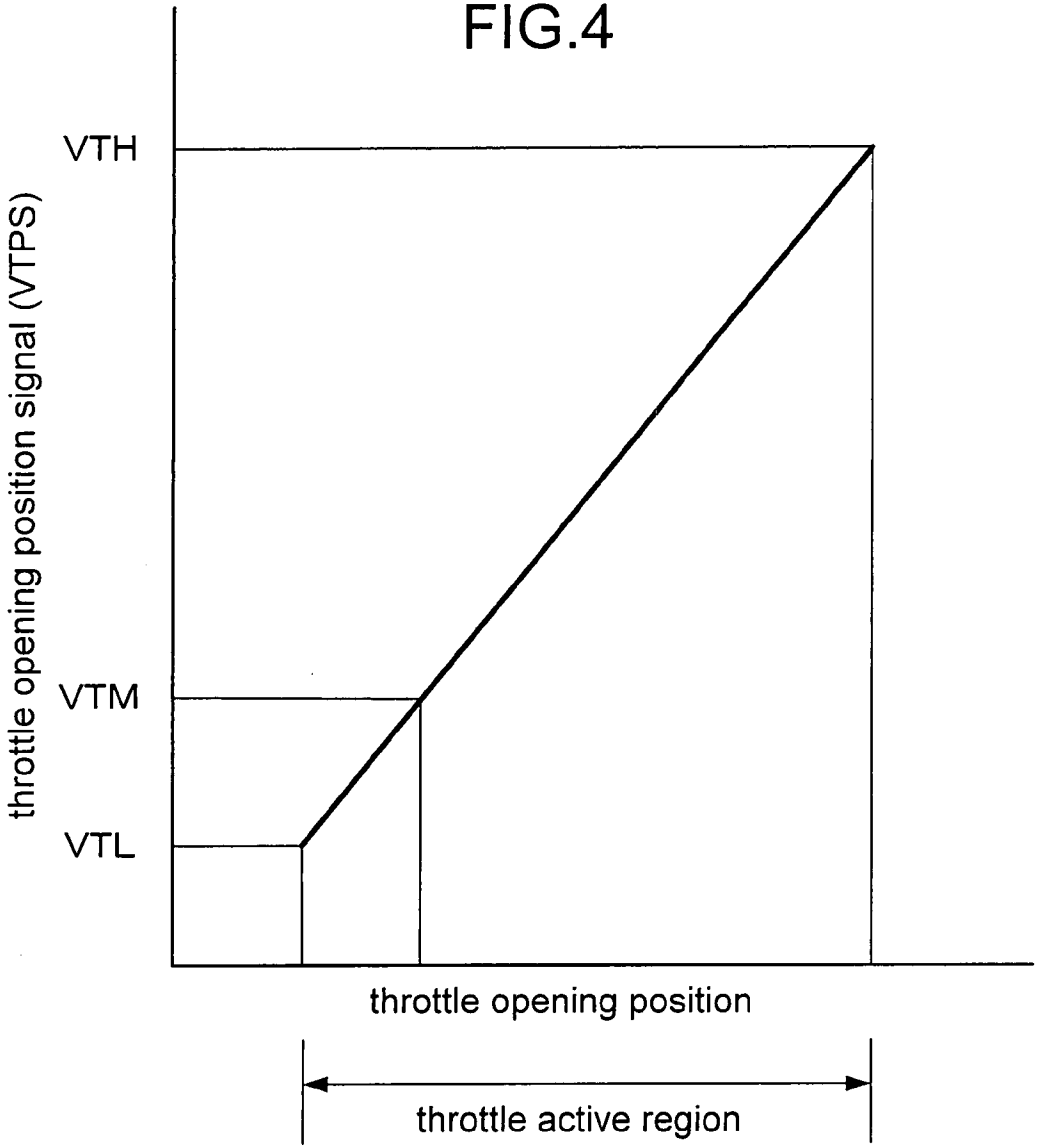
FIG. 4 is a graph illustrating the output characteristic of a throttle opening sensor.

Referring to the drawings, FIG. 1 is a block diagram that shows the configuration of an electronic throttle control apparatus according to a first embodiment of the present invention. FIG. 2 and FIG. 3 are configuration views around a throttle valve, and FIG. 4 is a graph that illustrates the output characteristic of a throttle opening sensor.

The electronic throttle control apparatus, generally designated at 1, includes an accelerator opening sensor (APS) 2 that detects the position of an unillustrated accelerator pedal as the degree of opening of an accelerator (hereinafter referred to as an accelerator opening), a throttle actuator 3 that controls the amount of intake air sucked into an unillustrated engine, and an electronic control unit (ECU) 4 that controls the throttle actuator 3.

The throttle actuator 3 includes a DC motor 10, a speed reduction gear 11 that decelerates the rotation of a DC motor 10 thereby to increase its driving force, a throttle shaft 12 to which the rotation of the speed reduction gear 11 is transmitted, a throttle valve 13 that opens and closes an unillustrated air intake passage in accordance with the rotation of the throttle shaft 12 thereby to control the amount of intake air, and a throttle opening sensor (TPS) 14 that is connected with the throttle shaft 12 for detecting the position of the throttle valve 13 as an actual throttle opening position.

The electronic control unit 4 includes a microcomputer 16 that outputs a feedback control signal for controlling the actual throttle opening position in a feedback manner by using an accelerator opening signal from the accelerator opening sensor 2, a throttle opening position signal from the throttle opening sensor 14 and an engine rotational speed signal, and a drive circuit 17 that controls the DC motor 10 based on the feedback control signal from the microcomputer 16.

The microcomputer 16 includes an A/D converter 20 that A/D converts the input accelerator opening signal, the input throttle opening position signal and the input engine rotational speed signal into a corresponding degree of accelerator opening, an actual throttle opening position, and an engine rotational speed, respectively, a target calculation section 21 that calculates a target throttle opening position based on the degree of accelerator opening and the engine rotational speed, a feedback control section 22 that contains a feedback control signal by carrying out feedback control calculations to as to make the actual throttle opening position coincide with the target throttle opening position, and a timer 23 for measuring time.

The feedback control signal is a duty signal at the time of PWM driving for example, and the drive circuit 17 serves to flow a desired amount of current into the DC motor 10 thereby to rotate the throttle valve 13.

Now, reference will be made to a structure around the throttle valve 13 while referring to FIG. 2.

The following stoppers are arranged around the throttle valve 13. That is, a fully closing stopper 31 is arranged at a position at which an intake pipe 30 is fully closed when the throttle valve 13 is stopped by abutment against the stopper 31 (hereinafter referred to as a fully closed stopper position). An intermediate opening stopper 32 is arranged at a position at which the intake pipe 30 is opened at an intermediate degree of opening when the throttle valve 13 is stopped by abutment against the stopper 32 (hereinafter referred to as an intermediate opening stopper position). A fully opening stopper 33 is arranged at a position at which the intake pipe 30 is fully opened when the throttle valve 13 is stopped by abutment against the stopper 33 (hereinafter referred to as a fully opened stopper position).

In addition, attached to the throttle valve 13 are a return spring 34 that urges the throttle valve 13 to rotate toward the fully closing stopper 31, and an opener spring 35 that urges the throttle valve 13 to rotate in the opposite direction toward the fully opening stopper 33. Here, note that in order to stop the throttle valve 13 at the intermediate opening stopper position when the driving force from the DC motor 10 is not applied to the throttle shaft 12, an urging force $F_2$ of the opener spring 35 is set greater than an urging force $F_1$ of the return spring 34. The return spring 34, the opener spring 35, whose urging forces are set in this manner, and the intermediate opening stopper 32 are collectively called, or cooperate with one another to form, an intermediate opening position stopping mechanism.

Next, reference will be made to a relation between those forces which act on the throttle shaft 12. Note that in FIG. 2, the throttle valve 13 is shown as being stopped at the intermediate opening stopper position when the DC motor 10 is brought into a non-energized state, and in FIG. 3, the throttle valve 13 is shown as being placed at a location in the vicinity of the fully closing stopper position under the drive of the DC motor 10 during the idle speed control of the engine.

When the DC motor 10 is put into a non-energized state, the torque generated by the DC motor 10 becomes zero, so the driving force FM of the DC motor 10 transmitted to the throttle shaft 12 through the speed reduction gear 11 also becomes zero. At this time, the urging force $F_1$ of the return spring 34 and the urging force $F_2$ of the opener spring 35 act on the throttle shaft 12 so as to counteract with each other, but since the urging force $F_2$ of the opener spring 35 is set greater than the urging force $F_1$ of the return spring 34, the throttle valve 13 is stopped by abutting against the intermediate opening stopper 32.

Moreover, when the DC motor 10 is driven to rotate in the same direction as that of the urging force $F_1$ of the return spring 34 (hereinafter referred to as a fully closed direction), the value of the sum of the driving force FM from the DC motor 10 and the urging force $F_1$ of the return spring 34 becomes larger than the urging force $F_2$ of the opener spring 35, so the throttle valve 13 is stopped by abutting against the fully closing stopper 31.

On the other hand, when the DC motor 10 is driven to rotate in a direction opposite to that of the urging force $F_1$ of the return spring 34 (hereinafter referred to as the fully opening direction), the driving force FM from the DC motor 10 becomes larger than the urging force $F_1$ of the return spring 34, so the throttle valve 13 is stopped by abutting against the fully opening stopper 33.

Further, the DC motor 10 is driven to rotate in a direction opposite to that of the urging force $F_2$ of the opener spring 35 to cause the throttle valve 13 to rotate in the fully closed direction, whereby the throttle valve 13 can be stopped in the vicinity of the fully closed stopper position by a balance between the sum of the driving force FM of the DC motor 10 and the urging force $F_1$ of the return spring 34 and the urging force $F_2$ of the opener spring 35, as shown in FIG. 3. The position of the throttle valve 13 can be monitored by means of the ECU 4 by using a signal output as the throttle opening position signal from the throttle opening sensor (TPS) 14 connected with the throttle shaft 12.

Next, reference will be made to the output characteristic of the throttle opening sensor 14 wide referring to FIG. 4.

The throttle opening sensor 14 outputs a fully closed position VTL of, for example, 0.5 V when the throttle valve 13 is stopped at the fully closed stopper position, and a fully opened position VTH of, for example, 4.5 V when the throttle valve 13 is stopped at the fully opened stopper position. Also, the throttle opening sensor 14 outputs an intermediate opening stopper position VTM of, for example, 0.8 V when the DC motor 10 is in the non-energized state, and when the throttle valve 13 is stopped at the intermediate opening stopper position.

Figure 5:
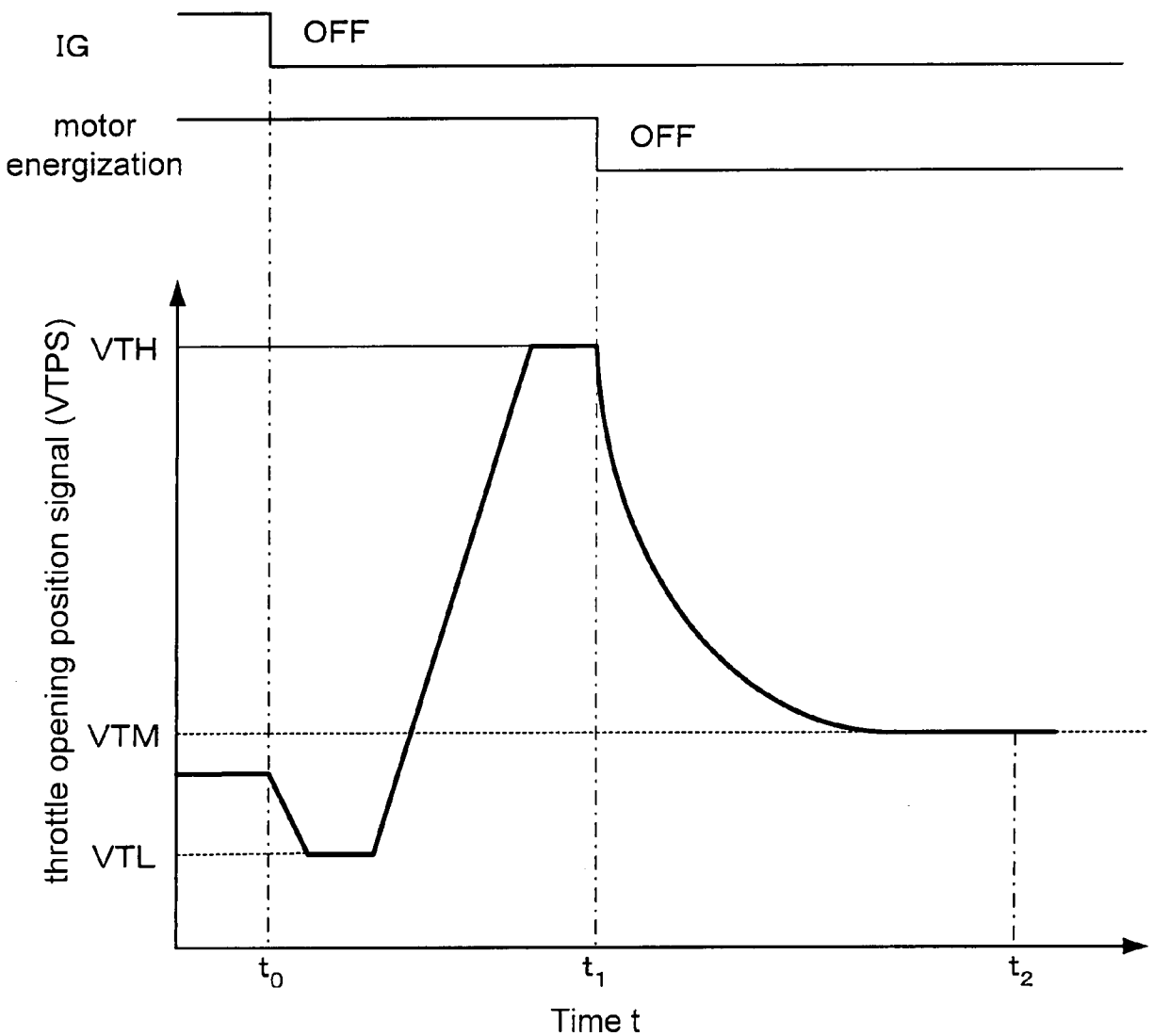
FIG. 5 is a timing chart illustrating the appearance of the change in an output of the throttle opening sensor when the energization of a motor has been interrupted with the throttle valve being in the fully opened position.

FIG. 5 is a timing chart that illustrates the change of the throttle opening position signal when the respective opening positions of the throttle valve 13 are learned with an ignition key switch being tuned off.

Now, reference will be made to the learning of the respective opening positions of the throttle valve 13 with the ignition key switch being turned off.

When a signal indicating that the unillustrated engine key switch has been changed into a turned off state is input to the microcomputer 16, the timing of the timer 23 is started, and this starting time point is set as t0. At the same time, the DC motor 10 is driven to cause the throttle valve 13 to rotate up to the fully closed stopper position, and then it is stopped temporarily, so that the throttle opening position signal from the throttle opening sensor 14 is read and stored as a fully closed position learning value VTLLN. Thereafter, the DC motor 10 is again operated to rotate the throttle valve 13 up to the fully opened stopper position, and then it is stopped temporarily, so that the throttle opening position signal from the throttle opening sensor 14 is read and stored as a fully opened position learning value VTHLN. Here, note that the reading and storing of the throttle opening position signal at the time when the throttle valve is stopped at each stopper position in this manner is referred to as learning.

When the supply of power to the DC motor 10 is interrupted, for example, by actuating an unillustrated relay after the learning of the fully opened position learning value VTHLN has been completed (at a time point $t=t_1$), the throttle valve 13 is returned to the intermediate opening stopper position, for example, after the lapse of 1.0 second at the time when the return spring 34 is normal. Accordingly, the throttle opening position signal coincides with the intermediate opening stopper position VTM.

Then, the throttle opening position signal after the lapse of a predetermined time such as for example 3 seconds (at a time point $t=t_2$), which is a margin enough for the throttle valve 13 to return to the intermediate opening stopper position upon interruption of the supply of power to the DC motor 10 (at a time point $t=t_1$), is read and stored as an intermediate opening stopper position learning value VTMLN.

Thus, by learning the intermediate opening stopper position learning value VTMLN at the time when the engine key switch can be turned off, it is possible to remove the deviation of the intermediate opening stopper position due to the mechanical tolerance of the intermediate opening position stopping mechanism.

Figure 6:
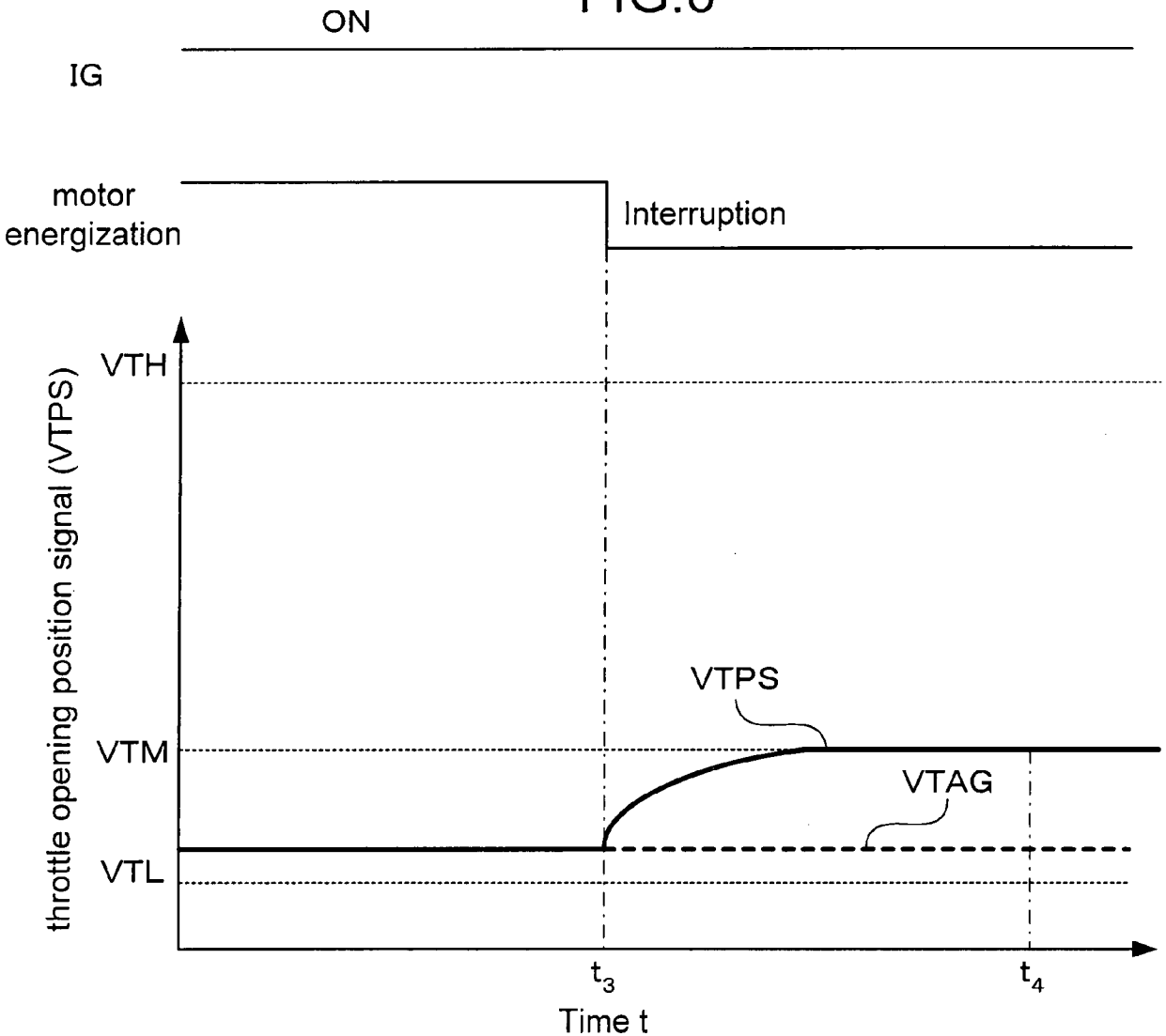
FIG. 6 is a timing chart illustrating the appearance of the change in the output of the throttle opening sensor when an open-circuit failure of the motor has occurred with the throttle valve being in a low opening range.

FIG. 6 is a timing chart that illustrates the change of the throttle opening position signal when the ignition key switch is in the turned on state and when an open circuit occurs in the DC motor 10 during the time when the ECU 4 controls the throttle actuator 3 in a throttle opening feedback control manner.

When an open-circuit failure occurs in the DC motor 10 (at a time point $t=t_3$), the driving force FM of the DC motor 10 becomes zero, so after the lapse of a predetermined time (at a time point $t_4$), the throttle valve 13 is returned to the intermediate opening stopper position under the action of the urging force $F_2$ of the opener spring 35 that is set greater than the urging force $F_1$ of the return spring 34, and the throttle opening position signal comes to coincide with the intermediate opening stopper position VTM.

The open-circuit failure of the DC motor 10 can be detected by verifying that the throttle valve 13 is in the intermediate opening stopper position, from the fact that the absolute value of an opening position deviation between the actual throttle opening position and the intermediate opening stopper position VTM is less than or equal to the first predetermined value, as well as by verifying that a motor current increases so as to reduce a control deviation between the target throttle opening position and the actual throttle opening position to zero under the action of throttle opening feedback control, from the fact that the absolute value of the control deviation is greater than or equal to the second predetermined value.

Figure 7:
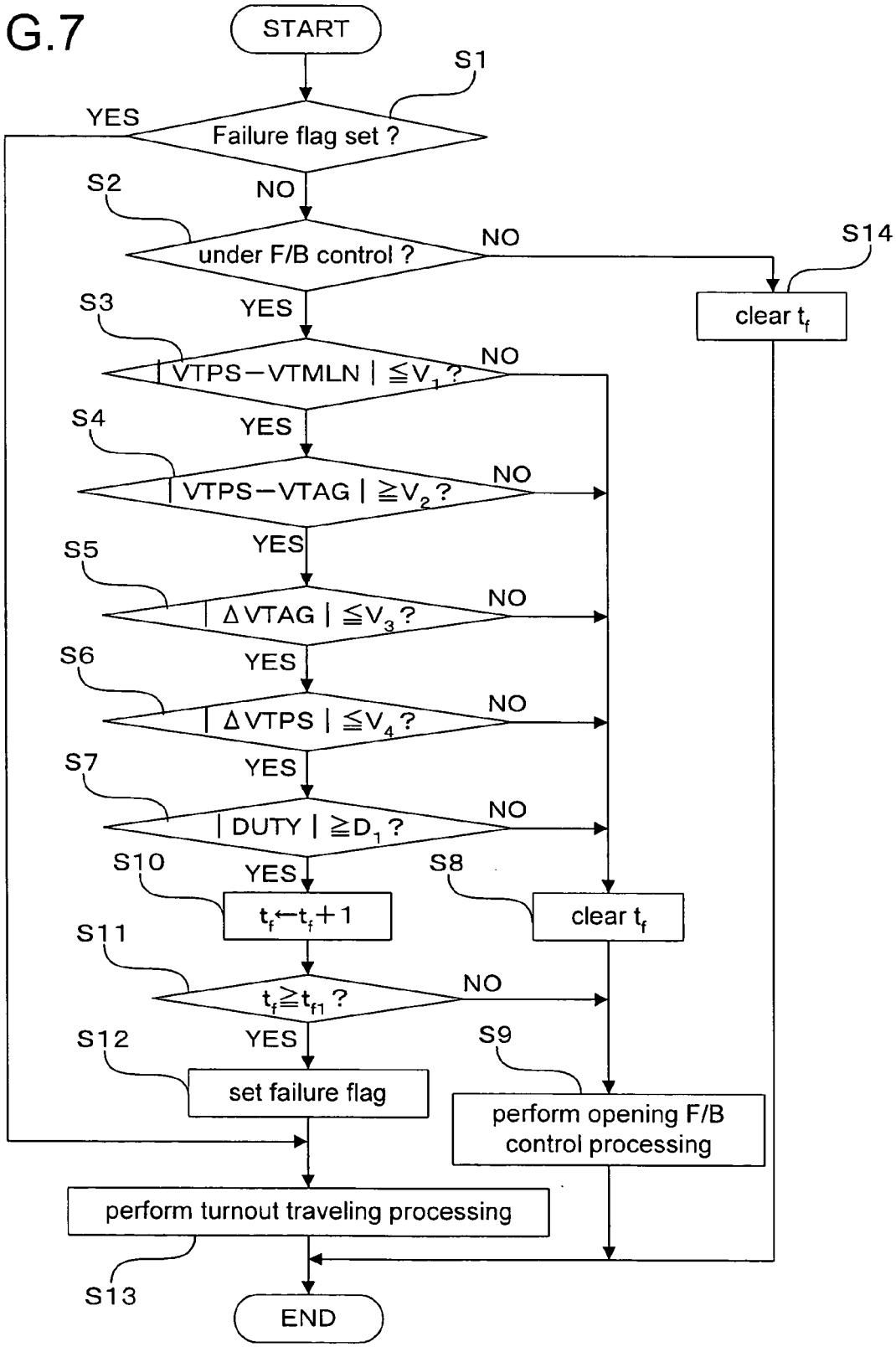
FIG. 7 is a flow chart illustrating the procedure of motor open-circuit failure determination processing in the electronic throttle control apparatus according to the first embodiment of the present invention.

FIG. 7 is a flow chart that illustrates the procedure of motor open-circuit failure determination processing in the electronic throttle control apparatus according to the first embodiment of the present invention.

Now, reference will be made to the procedure of motor open-circuit failure determination processing in the electronic throttle control apparatus 1 according to the first embodiment of the present invention while referring to FIG. 7.

In step S1, at each predetermined processing period of, for example, 5 msec, it is determined whether a motor open-circuit failure flag F has been set, and when the motor open-circuit failure flag F has been set, the control flow proceeds to step S13, whereas when the motor open-circuit failure flag F has not been set, the control flow proceeds to step S2.

In step S2, it is determined whether the throttle valve 13 is under throttle opening feedback control, and when the throttle valve 13 is not under throttle opening feedback control, the control flow proceeds to step S14, whereas when the throttle valve 13 is under throttle opening feedback control, the control flow proceeds to step S3.

In step S3, it is determined whether the absolute value of the opening position deviation |VTPS−VTMLN| between the actual throttle opening position VTPS and the intermediate opening stopper position learning value VTMLN is equal to or less than a first predetermined value $V_1$ (e.g., 0.05 V), and when the absolute value of the opening position deviation |VTPS−VTMLN| exceeds the first predetermined value $V_1$, the control flow proceeds to step S8, whereas when the absolute value of the opening position deviation |VTPS−VTMLN| is equal to or less than the first predetermined value $V_1$, the control flow proceeds to step S4.

In step S4, it is determined whether the absolute value of the control deviation |VTPS−VTAG| between the actual throttle opening position VTPS and the target throttle opening position VTAG is greater than a second predetermined value $V_2$ (e.g., 0.1 V), and when the absolute value of the control deviation |VTPS−VTAG|is less than the second predetermined value $V_2$, the control flow proceeds to step S8, whereas when the absolute value of the control deviation |VTPS−VTAG| is equal to or greater than the second predetermined value $V_2$, the control flow proceeds to step S5.

In step S5, it is determined whether the absolute value of the change speed |ΔVTAG| of the target throttle opening position in a predetermined processing period is less than or equal to a third predetermined value $V_3$ (e.g., 0.05 V), and when the absolute value of the change speed |ΔVTAG| exceeds the third predetermined value $V_3$, the control flow proceeds to step S8, whereas when the absolute value of the change speed |ΔVTAG| is less than or equal to the third predetermined value $V_3$, the control flow proceeds to step S6.

In step S6, it is determined whether the absolute value of the change speed |ΔVTPS| of the actual throttle opening position is less than or equal to a fourth predetermined value $V_4$, and when the absolute value of the change speed |ΔVTPS| exceeds the fourth predetermined value $V_4$, the control flow proceeds to step S8, whereas when the absolute value of the change speed |ΔVTPS| is less than or equal to the fourth predetermined value $V_4$, the control flow proceeds to step S7.

In step S7, it is determined whether the absolute value of a motor drive duty |DUTY| is greater than or equal to a fifth predetermined value $D_1$, and when the absolute value of the motor drive duty |DUTY| is less than the fifth predetermined value $D_1$, the control flow proceeds to step S8, whereas when the absolute value of the motor drive duty |DUTY| is greater than or equal to the fifth predetermined value $D_1$, the control flow proceeds to step S10.

In step S8, since a failure determination condition is not satisfied, the control flow proceeds to step S9 while clearing a failure determination timer counter $t_f$, and in step S9, throttle opening feedback control is performed, and the processing in one processing period is terminated. In step S10, the failure determination timer counter is counted up ($t_f=t_f+1$), and the control flow proceeds to step S11.

In step S11, it is determined whether the count value $t_f$ of the failure determination timer counter is greater than or equal to a timer predetermined value $t_{f1}$ of, for instance, 0.5 sec, and when the count value $t_f$ is less than the timer predetermined value $t_{f1}$, the control flow proceeds to step S9, whereas when the count value $t_f$ is greater than or equal to the timer predetermined value $t_{f1}$, the control flow proceeds to step S12.

In step S12, a determination is made that there is a motor open-circuit failure, so a failure determination flag F is set, and the control flow proceeds to step S13.

In step S13, as an evacuation or limp-home traveling processing, the supply of power to the throttle actuator 3 is interrupted for example by turning off an unillustrated relay, so that the throttle valve 13 is returned to the intermediate opening throttle position in the form of an opening position for evacuation traveling thereby to limit the engine power for evacuation traveling, and the processing is terminated.

In step S14, since the failure determination condition is not satisfied unless the throttle valve 13 is under throttle opening feedback control, the failure determination timer counter $t_f$ is cleared, and the processing in one processing period is terminated.

In this electronic throttle control apparatus 1, by focusing on the fact that upon occurrence of a motor open-circuit failure, the throttle valve 13 is mechanically returned to the intermediate opening stopper position by means of the intermediate opening position stopping mechanism, the absolute value of the opening position deviation between the actual throttle opening position and the intermediate opening stopper position is less than or equal to the first predetermined value during the time when the DC motor 10 is energized to perform throttle opening feedback control, so it is verified that the throttle valve 13 is returned to the intermediate opening stopper position. In addition, the absolute value of the control deviation between the target stopper opening position and the stopper opening position is larger than or equal to the second predetermined value, so it is verified that the motor current is increased so as to reduce the control deviation to zero through the throttle opening feedback control, and when this state continues over the predetermined time, it is determined that the motor energization system is in an open-circuit failure. As a result, it is possible to detect the open-circuit failure of the motor energization system in a reliable manner without the need of detecting the motor current.

Moreover, the actual throttle opening position during non-energization of the motor is learned, and the intermediate opening stopper position learning value is used to calculate the opening position deviation, as a consequence of which the variation of the intermediate opening stopper position due to the mechanical tolerance of the intermediate opening position stopping mechanism becomes small, so the open-circuit failure of the motor energization system can be accurately determined.

Further, since the open-circuit failure determination is made only when the absolute value of the change speed of the actual throttle opening position is less than or equal to the predetermined value, it is possible to prevent incorrect determination in case where there occurs a delay in the follow-up operation of the actual throttle opening position to the target throttle opening position at the time of throttle opening and closing operation such as driver's accelerator pedal operation or the like.

Furthermore, since the open-circuit failure determination is made only when the absolute value of the motor drive duty during throttle opening feedback control is greater than or equal to the predetermined value, the fourth predetermined value for the absolute value of the control deviation between the target throttle opening position and the actual throttle opening position, which is an open-circuit determination condition or criterion for the motor energization system, can be set smaller, so it is possible to expand a failure detection opening range and prevent incorrect determination as well.

Thus, the motor open-circuit failure detection for the throttle actuator 3 can be detected based on the actual throttle opening position, the target throttle opening position, and the intermediate opening stopper position learning value without the need of detecting the motor current, so it is possible to carry out accurate failure detection at low cost.

In addition, since the output power of the engine is limited when a failure determination is made, the driver can be informed of such an abnormality, so that it is possible to ensure safety during travel of the vehicle by urging the driver to do early replacement of abnormal parts with normal ones.

Embodiment 2

In the above-mentioned electronic throttle control apparatus 1 according to the first embodiment of the present invention, the second predetermined value $V_2$ common in the entire opening range is used as a threshold value for determination of an open-circuit failure corresponding to the absolute value of the control deviation between the target throttle opening position VTAG and the actual throttle opening position VTPS regardless of the driving direction of the throttle valve 13, but in an electronic throttle control apparatus according to a second embodiment of the present invention, different determination values corresponding to the absolute value of the control deviation are used, for the open-circuit failure determination of the motor energization system, depending upon the driving direction of the throttle valve 13 with respect to the intermediate opening stopper position. That is, as such determination values, a sixth predetermined value $V_{2O}$ of, for example, 0.1 V is used when the throttle value 13 is driven to rotate in its fully closed direction, whereas a seventh predetermined value $V_{2O}$ of, for example, 0.5 V is used when the throttle valve 13 is driven to rotate in its fully opened direction. The configuration of this second embodiment other than the above is similar to that of the first embodiment, and hence like components or parts are identified by the same symbols while omitting a detailed explanation thereof.

Figure 8:
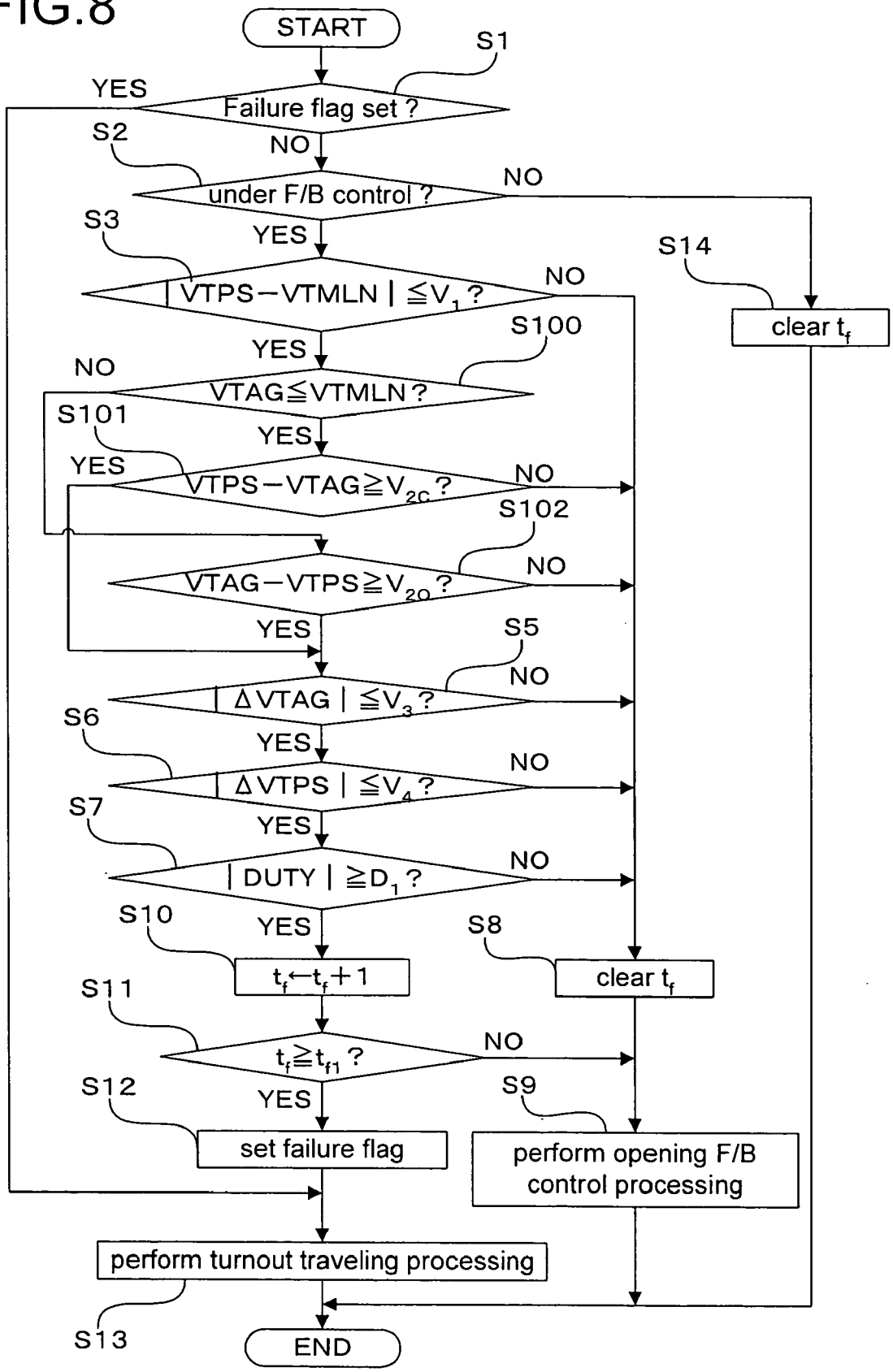
FIG. 8 is a flow chart illustrating the procedure of motor open-circuit failure determination processing in an electronic throttle control apparatus according to a second embodiment of the present invention.

FIG. 8 is a flow chart that illustrates the procedure of motor open-circuit failure determination processing in the electronic throttle control apparatus according to the second embodiment of the present invention.

Now, reference will be made to the procedure of motor open-circuit failure determination processing in the electronic throttle control apparatus according to the second embodiment of the present invention while referring to FIG. 8. Here, note that in the procedure of FIG. 8, the same symbols are attached to the same processing blocks as in FIG. 7, while omitting an explanation thereof.

In step S100, it is determined whether the target throttle opening position VTAG is less than or equal to the intermediate opening stopper position learning value VTMLN, and when the target throttle opening position VTAG is less than or equal to the intermediate opening stopper position learning value VTMLN, the control flow proceeds to step S101, whereas when the target throttle opening position VTAG exceeds the intermediate opening stopper position learning value VTMLN, the control flow proceeds to step S102.

In step S101, it is determined whether a control deviation obtained by subtracting the target throttle opening position VTAG from the actual throttle opening position VTPS is greater than or equal to the sixth predetermined value (fully closed side threshold value) $V_{2C}$ (e.g., 0.1 V), and when the control deviation is less than the fully closed side threshold value $V_{2C}$, the control flow proceeds to step S8, whereas when the control deviation is greater than or equal to the fully closed side threshold value $V_{2C}$, the control flow proceeds to step S5.

In step S102, it is determined whether a control deviation obtained by subtracting the actual throttle opening position VTPS from the target throttle opening position VTAG is greater than or equal to the seventh predetermined value (fully closed side threshold value) $V_{2O}$ (e.g., 0.5 V), and when the control deviation thus obtained is less than the fully opened side threshold value $V_{2O}$, the control flow proceeds to step S8, whereas when the control deviation is greater than or equal to the fully opened side threshold value $V_{2O}$, the control flow proceeds to step S5.

Thus, in the electronic throttle control apparatus according to the second embodiment of the present invention, the fully closed side threshold value $V_{2C}$ in the case of the target throttle opening position VTAG being on the fully closed side from the intermediate opening stopper position learning value VTMLN and the fully opened side threshold value $V_{2O}$ in the case of the target throttle opening position VTAG being on the fully opened side from the intermediate opening stopper position learning value VTMLN are individually set separately from each other.

In a low throttle opening range in which the actual throttle opening position is controlled from the intermediate opening stopper position to the fully closed side so as to run the engine at idle speed, it is possible to ensure an increased detection opening range and improved detection sensitivity by setting the threshold value for the control deviation to be small.

In a high throttle opening range in which the actual throttle opening position is controlled from the intermediate opening stopper position to the fully opened side, by setting the threshold value for the control deviation to be large, it is possible to ensure a margin against incorrect determination in case where there occurs a delay in the follow-up operation of the actual throttle opening position to the target throttle opening position at the time of throttle opening and closing operation such as driver's accelerator pedal operation or the like. As a result, there is obtained an advantageous effect for that it is possible to ensure both satisfactory detection sensitivity in the engine idle speed control operation range and an incorrect determination prevention margin in the high throttle opening range.

While the invention has been described in terms of preferred embodiments, those skilled in the art will recognize that the invention can be practiced with modifications within the spirit and scope of the appended claims.

What is claimed is:

1. An electronic throttle control apparatus comprising a throttle valve that adjusts an amount of intake air sucked into an engine, a throttle opening sensor that detects an actual throttle opening position of said throttle valve, and a throttle actuator that includes a motor for driving said throttle valve and an intermediate opening position stopping mechanism for holding said throttle valve at an intermediate opening stopper position when said motor is not energized, said throttle actuator being controlled in a throttle opening feedback manner such that the actual throttle opening position detected by said throttle opening sensor coincides with a target throttle opening position, wherein during the throttle opening feedback control of said throttle actuator, when said throttle valve continues, for a predetermined period of time, a state in which the absolute value of an opening position deviation between said actual throttle opening position and said intermediate opening stopper position is less than or equal to a first predetermined value, and a state in which the absolute value of a control deviation between said target throttle opening position and said actual throttle opening position is larger than or equal to a second predetermined value, it is determined that said motor is in an open-circuit failure.

2. The electronic throttle control apparatus as set forth in claim 1, wherein the actual throttle opening position detected when said motor is not energized with said throttle valve being stopped at said intermediate opening stopper position is used as an intermediate opening stopper position learning value of said intermediate opening stopper position in the calculation of said opening position deviation.

3. The electronic throttle control apparatus as set forth in claim 1, wherein only when the change speed of said target throttle opening position is less than or equal to a third predetermined value, and when the change speed of said actual throttle opening position is less than or equal to a fourth predetermined value, an open-circuit failure determination of said motor is made.

4. The electronic throttle control apparatus as set forth in claim 1, wherein only when the absolute value of a motor drive duty during the throttle opening feedback control of said throttle actuator is larger than or equal to a fifth predetermined value, an open-circuit failure determination of said motor is made.

5. The electronic throttle control apparatus as set forth in claim 1, wherein threshold values corresponding to the absolute value of said control deviation are separately set depending upon the driving direction of said throttle valve with reference to said intermediate opening stopper position.

* * * * *